US007744748B2

(12) United States Patent
Nicolaos et al.

(10) Patent No.: US 7,744,748 B2
(45) Date of Patent: Jun. 29, 2010

(54) PROCESS FOR DESULPHURIZING A HYDROCARBON FEED BY ADSORPTION/DESORPTION

(75) Inventors: Alexandre Nicolaos, Puteaux (FR); Florent Picard, Saint Symphorien d'Ozon (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 1283 days.

(21) Appl. No.: 10/898,185

(22) Filed: Jul. 26, 2004

(65) Prior Publication Data

US 2005/0061712 A1 Mar. 24, 2005

(30) Foreign Application Priority Data

Jul. 25, 2003 (FR) ..... 03 09199

(51) Int. Cl.
*C10G 45/00* (2006.01)

(52) U.S. Cl. ..... 208/208 R; 208/299; 208/213; 585/826

(58) Field of Classification Search ..... 208/208 R, 208/213, 299, 305
See application file for complete search history.

(56) References Cited

U.S. PATENT DOCUMENTS 3,051,646 A 8/1962 Brooke
5,454,933 A 10/1995 Savage et al.
5,843,300 A * 12/1998 Zinnen et al. ..... 208/250
6,551,501 B1 4/2003 Whitehurst et al.
2003/0042175 A1 3/2003 Debuisschert et al.

FOREIGN PATENT DOCUMENTS

EP 1057879 12/2000

* cited by examiner

*Primary Examiner*—Glenn A Caldarola
*Assistant Examiner*—John C. Douglas
(74) *Attorney, Agent, or Firm*—Millen, White, Zelano, Branigan, P.C.

(57) ABSTRACT

A process for reducing the quantity of sulphur present in a hydrocarbon feed such as a gasoline or a gas oil, comprises:

Figure 1:
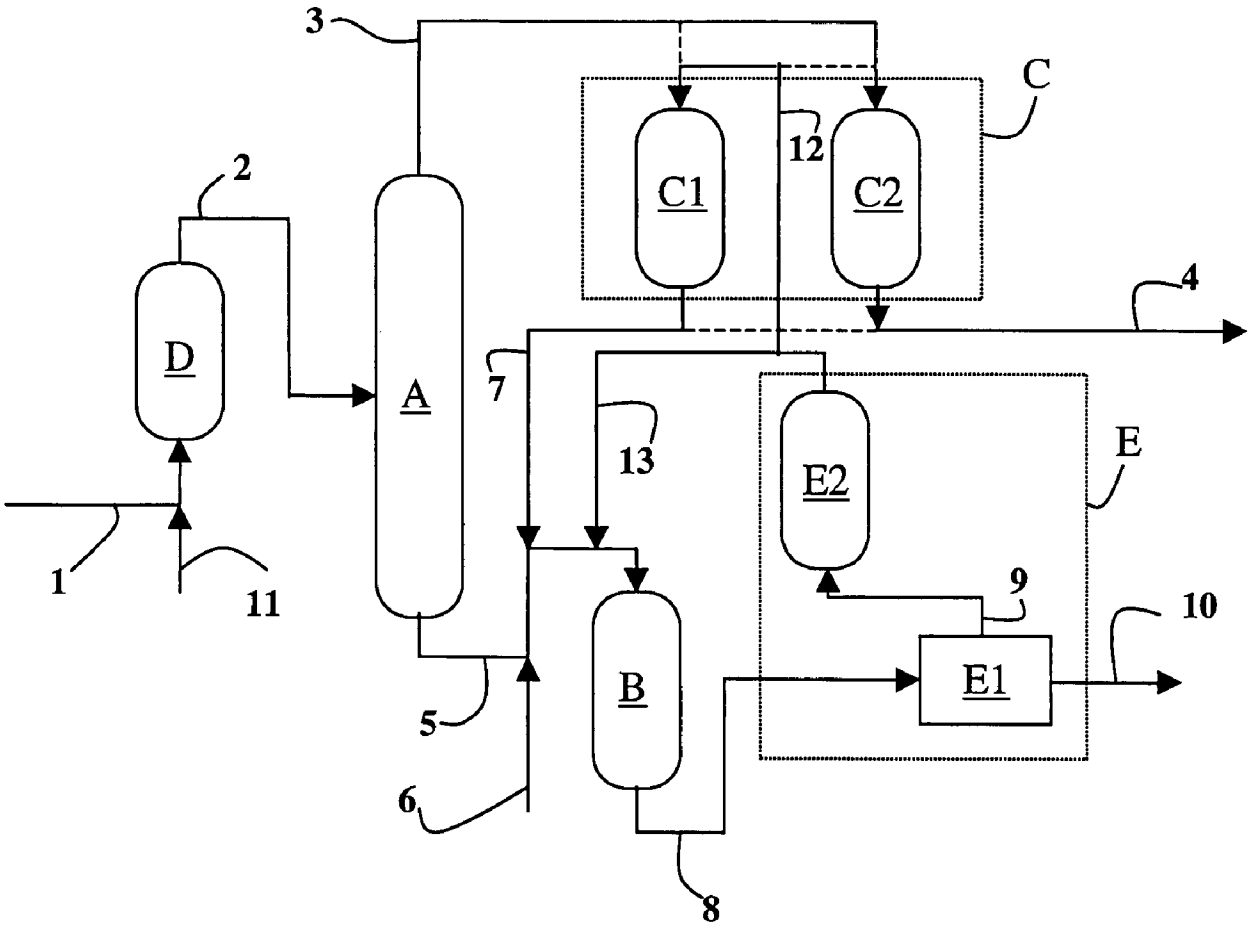

d) bringing said feed containing sulphur-containing compounds into contact with an adsorbent having a selectivity for sulphur-containing compounds under conditions for producing, at the outlet from the contact zone, a desulphurized effluent which is collected, said adsorption being carried out in the liquid phase or in the gas phase;

e) gas phase desorption of the sulphur-containing compounds present on said adsorbent using a hydrogen-containing gaseous fluid derived from a hydrodesulphurization zone to obtain a gaseous effluent comprising hydrogen and desorbed sulphur-containing compounds;

sending the gaseous effluent from step b) to said hydrodesulphurization zone and desulphurizing it therein.

4 Claims, 1 Drawing Sheet

PROCESS FOR DESULPHURIZING A HYDROCARBON FEED BY ADSORPTION/DESORPTION

The present invention relates to a process for desulphurizing a hydrocarbon feed, typically a gasoline with boiling points in the range 25° C. to 300° C. or a gas oil with boiling points in the range 150° C. to 350° C.

Future specifications for vehicle fuels will require a large reduction in the sulphur content of those fuels, and in particular gasoline. That reduction is intended in particular to limit the amount of sulphur and nitrogen oxides in vehicle effluent gases.

As an example, from 2000, European legislation has required that gasoline fuels should contain 150 pm of sulphur, 1% of benzene, 42% of aromatics and 18% of olefins. In 2005, these will amount to 50 ppm of sulphur and 35% of aromatics. Specifications in the United States are also changing, requiring a gasoline to contain an average of 30 ppm of sulphur from 2004. Similar restrictions also exist regarding the sulphur content of gas oils.

The change in sulphur content specifications in fuels thus necessitates the development of novel deep desulphurization processes for gasolines and gas oils.

In the case of gasoline desulphurization, it is known that the principal sources of sulphur derive from cracking gasolines, principally the gasoline fraction from a process for catalytic cracking of an atmospheric distillation residue or vacuum residue from a crude oil (FCC). The gasoline fraction from catalytic cracking, which represents an average of 40% of the gasoline stock, contributes more than 90% of the sulphur in such gasoline. As a result, the production of low sulphur gasoline necessitates a step for desulphurizing catalytic cracking gasoline. Other sulphur-rich gasoline sources that can be cited are cokefaction gasoline or, to a lesser extent, gasoline from atmospheric distillation, or steam cracking gasoline. Currently, desulphurization is conventionally carried out in one or more steps for bringing sulphur-containing compounds contained in said gasoline into contact with a hydrogen-rich gas in a process known as hydrodesulphurization, in which the organic sulphur is transformed into hydrogen sulphide ($H_2S$) which is then separated from the desulphurized gasoline by degassing.

The octane number is routinely used as an indicator of the resistance to self-ignition of fuels, particularly gasoline. A high octane number for the gasoline produced is vital to the refiner in order to control the quality of that gasoline, with a view to a use as vehicle engine fuel.

Further, the octane number of gasolines is known to be linked to their olefin content. Thus, preserving the octane number of said gasoline necessitates limiting reactions transforming olefins into paraffins which are inherent to hydrodesulphurization processes.

When gasoline is desulphurized using a conventional hydrodesulphurization process, it is known that olefin hydrogenation (saturation) reactions occurring in parallel to the transformation of sulphur-containing compounds to $H_2S$ results in a reduction in the octane number of the desulphurized gasoline finally recovered. Further, the quantities of hydrogen used in such processes are higher for greater degrees of desulphurization. High hydrogen partial pressures encourage olefin hydrogenation reactions. Thus, to restrict the sulphur contents of that gasoline, such processes result in very high losses in octane number.

Further, when only conventional processes are used, the use of very large quantities of hydrogen in hydrodesulphurization units for gasoline or gas oils risks causing problems in managing that gas in the refinery.

Possible hydrocarbon desulphurization routes include processes for purification of sulphur-containing compounds by adsorption on a selective adsorbant.

As an example, U.S. Pat. No. 3,620,969 recommends using a zeolite to desulphurize a liquid hydrocarbon by adsorption.

U.S. Pat. No. 6,428,685 recommends contact with a specific solid containing a promoter comprising nickel the valency of which has been reduced to a value of 2 or less to desulphurize a FCC gasoline or gas oil.

International patent application WO-A-00/77124 proposes desulphurizing a hydrocarbon by adsorption and carrying out regeneration with a refinery fluid with boiling points corresponding to that of the hydrocarbon treated. The stream obtained is then sent for hydrotreatment, which avoids the use of distillation trains to regenerate the solvent. However, adsorption and desorption are carried out in the liquid phase, which implies treating a fraction of the treated hydrocarbon in a new desulphurization unit.

The present invention pertains to a process for desulphurization by adsorbing a hydrocarbon cut as described above onto a solid adsorbant.

The present process can achieve both adsorption selectivity regarding sulphur-containing compounds present in the initial feed, restricted hydrogen consumption and can also satisfy future specifications regarding sulphur in gasoline and/or gas oil.

Further, when treating a gasoline feed, the present invention enables desulphurization of said gasoline to be carried out with minimal octane number loss.

In accordance with the sequence proposed in the present invention, a minimal portion of the hydrocarbons contained in the initial cut is sent to a hydrodesulphurization unit.

In a preferred implementation in which adsorption is carried out in the gas phase, the present process can also minimize the hydrocarbon loss during the adsorption-desorption cycles.

In its most general form, the invention provides a process for reducing the quantity of sulphur present in a hydrocarbon feed, comprising the following steps:

a) bringing said feed containing sulphur-containing compounds into contact with an adsorbant having a selectivity for sulphur-containing compounds under conditions for producing, at the outlet from the contact zone, a desulphurized effluent which is collected, said adsorption being carried out in the liquid phase or in the gas phase;

b) gas phase desorption of the sulphur-containing compounds present on said adsorbant using a gaseous fluid comprising hydrogen and deriving from a hydrodesulphurisation zone to obtain a gaseous effluent comprising desorbed sulphur-containing compounds and the gaseous fluid comprising hydrogen;

c) sending the effluent from step b) to said hydrodesulphurization zone and desulphurizing it therein.

The hydrocarbon feed may be a gasoline or a gas oil.

In a first implementation of the invention, adsorption is carried out in the gas phase. In this mode, a step for stripping the hydrocarbons present in the pores of the adsorbant can be carried out prior to the desorption step.

In a second implementation of the invention, adsorption is carried out in the liquid phase.

In this mode, a step for draining hydrocarbons present in the interstitial space between the adsorbant particles can be carried out prior to the desorption step.

In general, the adsorbant comprises at least one element from the group constituted by silicas, aluminas, zeolites, activated charcoal, resins, clays, metal oxides and reduced metals.

Usually, the present invention is carried out successively by absorption steps and desorption steps using a device selected from the group constituted by permutable reactors, simulated moving beds and moving beds.

The invention also concerns a process for producing a gasoline with a low sulphur content and a high octane number from an initial gasoline comprising olefins and sulphur-containing compounds, said process comprising the following steps:

a) distilling the initial gasoline into at least two fractions, namely:
   - a light fraction comprising the lightest sulphur-containing compounds;
   - a heavy fraction comprising the heavy sulphur-containing compounds;
b) eliminating the sulphur-containing compounds comprised in said light fraction by adsorption onto a solid adsorbant, followed by a desorption step;
c) treating said heavy fraction under conditions that, in the presence of an excess of hydrogen, can decompose the sulphur-containing compounds contained in said heavy fraction into hydrocarbons and hydrogen sulphide, said treatment further comprising a step for recycling excess hydrogen;

said desorption step being carried out using hydrogen recycled during step c) as the desorption gas.

The gasoline production process described above can also comprise a prior step for selective hydrogenation of the initial gasoline.

Preferably, the initial gasoline comprises a hydrocarbon fraction derived from a catalytic cracking process, a fluid catalytic cracking process, from cokefaction, from visbreaking or from pyrolysis.

The invention will be better understood from the following description, made with reference to FIG. 1, of an apparatus that can be used to carry out the present process when treating a gasoline feed.

A gas from a cracking unit is sent via a line 1 to a selective hydrogenation reactor D, mixed with a stream of a gas comprising hydrogen via a line 11. This reaction section can optionally comprise a catalyst that is capable of both hydrogenating diolefins and rendering light mercaptan type sulphur-containing compounds heavier. The effluent from reactor D is sent via a line 2 to distillation means A which produces an overhead light fraction, along with a heavy fraction from the column bottom.

The light fraction recovered via line 3 is sent to desulphurization means using vapour phase adsorption comprising capacities C1 and C2. A step for heating said fraction may be necessary to obtain complete vaporization. The adsorption desulphurization means in this example comprise two capacities disposed in parallel. Alternatively, one capacity functions in adsorption when the other functions in desorption. Swinging from one functional mode to the other is achieved by known means of systems for opening and closing valves (not shown). For clarity, the solid lines in FIG. 1 show the functional mode of the unit in which the capacity C1 is in the desorption phase while the capacity C2 is in the adsorption phase. The desulphurized gasoline recovered from the outlet from capacity C2 can be sent to the gasoline pool via line 4. Capacity C1 is supplied with a desorption gas via a line 12. After drainage, the effluent from the outlet from capacity C1 in the desorption phase concentrates the sulphur-containing compounds in the desorption gas and is evacuated via a line 7 for mixing with the heavy fraction derived from distillation means A via a line 5. The mixture obtained is sent to a conventional hydrodesulphurization section B, mixed with a stream of makeup hydrogen introduced via a line 6. The sulphur-containing compounds contained in said mixture are transformed into hydrocarbons and into hydrogen sulphide ($H_2S$). The effluent from section B is evacuated via a line 8 and sent to a separation section E. The heavy fraction of the desulphurized gasoline is separated from the hydrogen and $H_2S$ in section E1 after cooling and is sent to the gasoline pool via line 10. The gaseous fraction essentially constituted by hydrogen sulphide and hydrogen is sent via a line 9 to an amine washing unit E2 of known technology during which the hydrogen is purified. A portion of the purified hydrogen can then be recycled to the head of the hydrodesulphurization section B via a line 13, the complement being used as a desorption agent and entraining sulphur-containing compounds present on the surface or in the pores of the adsorbant employed in zone C via a line 12. If necessary, and within the scope of the invention, all of the purified hydrogen can be used as an agent for desorption and entrainment of sulphur-containing compounds, i.e. sent to zone C via a line 12.

The conditions for carrying out the process can be those now described, for example. The description below is given by way of example only and in no way limits the field of application of the present process. In this description, the initial hydrocarbon cut is arbitrarily selected to be a gasoline cut from a FCC process, adjudged representative of cuts to which the present process can be applied.

Fractionation (step A):

In one implementation of the invention (mode I), the gasoline is fractionated into two fractions:

- a light fraction containing the majority of olefins containing 5 or 6 carbon atoms as well as thiophene, and preferably methylthiophenes;
- a heavy fraction containing no more olefins containing 5 carbon atoms and concentrating the heavy sulphur-containing compounds such as benzothiophenes.

Since thiophene is known to form azeotropes with hydrocarbons, which azeotropes have a boiling point which is lower than that of thiophene, the light fraction generally has an end point in the range from about 70° C. to about 200° C., preferably in the range about 80° C. to about 160° C., and more preferably between about 90° C. and about 130° C. or even between 90° C. and 110° C.

This separation is carried out conventionally in a distillation column.

In a preferred implementation of the invention (mode II), the gasoline is distilled into three fractions:

- a light fraction comprising the compounds contained in the initial gasoline with a boiling point which is lower than the boiling point of thiophene;
- an intermediate fraction comprising at least the major portion (more than 50% by weight, preferably more than 70% by weight) of thiophene, preferably all of the thiophene, with an end point in the range about 70° C. to about 200° C., preferably in the range about 80° C. to about 160° C., more preferably in the range about 90° C. to about 130° C., or in the range about 90° C. to about 110° C.;
- a heavy fraction concentrating the heavy sulphur-containing compounds such as benzothiophenes.

In this case, adsorption/desorption step C is carried out on the intermediate fraction.

In an advantageous mode of the invention, the cut point of said distillation is selected as a function of the composition of the initial gasoline to be treated and/or as a function of the concentration of aromatic hydrocarbons present in the light fraction (mode I) or in the intermediate fraction (mode II) after fractionation.

Hydrodesulphurization of the heavy fraction (step B):

The sulphur-rich heavy fraction of the gasoline produced by step A is rich in sulphur and, in accordance with the invention, undergoes a desulphurization treatment. This step can be carried out by passing the gasoline in the presence of hydrogen over a catalyst comprising at least one element from group VIII (metals selected from iron, ruthenium, osmium, cobalt, rhodium, iridium, nickel, palladium and platinum) and/or at least one element from group VIB (element selected from the group constituted by chromium, molybdenum and tungsten), at least partially in the sulphide form. The reaction temperature is generally in the range 220° C. to 340° C. at a pressure in the range from about 1 to 4 MPa. The hourly space velocity is in the range about 1 $h^{-1}$ to 20 $h^{-1}$. The ratio of the hydrogen flow rate to the feed flow rate is in the range 100 to 600, expressed in normal liters of hydrogen per liter of gasoline.

The catalyst used to carry out hydrodesulphurization of the heavy fraction comprises between 0.5% and 15% by weight of group VIII metal, the percentage being expressed in the oxide form. The weight content of the group VIB metal is generally in the range 1.5% to 60% by weight, preferably between 3% and 50% by weight. The group VIII element is preferably cobalt and the group VIB element is preferably molybdenum or tungsten. The catalyst support is normally a porous solid such as magnesia, silica, titanium oxide or alumina, used alone or as a mixture.

This hydrodesulphurization step B can also comprise a hydrodesulphurization finishing step carried out on a catalyst comprising at least one element from group VIII, preferably selected from the group formed by nickel, cobalt and iron. The amount of metal in the catalyst is generally in the range about 1% to about 60% by weight in the oxide form. This finishing step can eliminate residual sulphur-containing compounds, principally saturated sulphur-containing compounds which have formed during the first hydrodesulphurization step. The reaction temperature is generally in the range 240° C. to 360° C. and must be at least 10° C. higher than the inlet temperature of the first hydrodesulphurization step. The pressure is in the range about 1 to 4 MPa. The hourly space velocity is in the range about 1 $h^{-1}$ to 20 $h^{-1}$. The ratio of the flow rate of hydrogen to the flow rate of feed is in the range 100 l/l to 600 l/l expressed in normal liters of hydrogen per liter of gasoline.

The hydrogen is recycled (via lines 13, 12, 7) using techniques which are well known to the skilled person.

Adsorption/desorption (step C):

This step consists of eliminating the sulphur-containing compounds from the light fraction (mode I) or the intermediate fraction (mode II) from step A.

In a preferred mode, said fractions have initially been depleted in mercaptan type compounds, for example by means of a selective hydrogenation step which will be described below. This step C can be carried out by bringing the feed to be treated into contact with a solid adsorbant having a high affinity for sulphur-containing compounds, preferably thiophene compounds. The solids used can be selected, alone or as a mixture, from families of adsorbants which are known to the skilled person selected from silicas, aluminas, zeolites, preferably faujasites, activated charcoals, resins, clays, metal oxides and reduced metals. It is possible to use a solid adsorbant having an increased adsorption capacity for sulphur-containing compounds obtained by physical surface treatments such as heat, or chemical treatments, for example grafting specific molecules onto the surface. It is also preferable to use solids the residual acidity of which is controlled to prevent coking reactions of olefins which can cause rapid aging of the solid used. To avoid this type of phenomenon it is possible, for example, to carry out potassium hydroxide or sodium hydroxide treatments.

In accordance with the invention, the solid is then regenerated/desorbed and this step is carried out by adsorption/regeneration cycles which are known per se to the skilled person. The experimental conditions are selected by the skilled person to maximize the dynamic capacity of the solid, for example by taking into account the quantity of sulphur retained in the adsorption phase and the quantity of liquid solvent or gas necessary to completely or partially regenerate the solid.

In accordance with the invention, desorption of the sulphur-containing compounds adsorbed on the surface of the adsorbant or in its pores is carried out using a gaseous fluid comprising hydrogen and derived from the hydrodesulphurization zone. The term "gaseous fluid comprising hydrogen" means a fluid comprising 1% to 100% molar of hydrogen, preferably 30% to 100% and more preferably 50% to 100 mole % of hydrogen.

In accordance with the invention, the fraction to be desulphurized can be treated during the adsorption phase either in the liquid phase or in the gas phase.

When adsorption is carried out in the liquid phase, it is advantageously carried out under mild temperature and pressure conditions, retaining the liquid phase and being typically from 0° C. to 100° C. and 0.1 to 10 MPa, and preferably from ambient temperature to 50° C. and 0.2 to 3 MPa.

In one implementation of the invention, initial draining can be carried out on the hydrocarbons retained in the pores after the adsorption phase prior to the desorption step and prior to passage of the gaseous fluid comprising hydrogen.

In a further mode, the scope of the invention encompasses desorption without draining by stripping compounds retained by the adsorbant (hydrocarbons and sulphur-containing compounds) by the gaseous fluid comprising hydrogen. The temperature of the fluid can be between 50° C. and 500° C. and is preferably between 80° C. and 300° C.

When adsorption is carried out in the gas phase, the subsequent regeneration phase can commence by stripping with a hot inert or non inert gas such as nitrogen, hydrogen, light hydrocarbons or steam prior to evacuating the gasoline retained in the pores. The temperature of this gas may be between 50° C. and 500° C., preferably between 80° C. and 300° C. Next, the fluid containing hydrogen allows desorption and evacuation of sulphur-containing compounds retained on the adsorbant during the adsorbant phase. Clearly, it is also possible to carry out desorption directly by passage of the gaseous fluid containing hydrogen.

In this implementation (adsorption and desorption in the gas phase), the quantity of gasoline retained in the gas phase in the pores of the adsorbantis is much lower than the quantity of gasoline retained for liquid phase adsorption. This minimizes hydrocarbon loss during the desulphurization process.

In accordance with the invention, the effluents derived from the phase carried out prior to desorption proper, i.e. draining (liquid phase adsorption) or stripping using an inert gas (gas phase adsorption) are either sent to the hydrodesulphurization zone or used directly as a gasoline stock. The choice between these alternatives is made by the refiner, for example as a function of the amount of sulphur in said effluents, the final sulphur content to be obtained for the entire gasoline (light, heavy and intermediate fraction), the quantity of said effluents and in particular the octane number loss linked to passing this quantity to the hydrodesulphurization zone.

Selective hydrogenation (step D):

This optional step, carried out prior to steps A, B, C, is intended to eliminate at least part of the diolefins present in the gasoline and to transform the light sulphur-containing compounds by rendering them heavier. Diolefins are gum precursors which polymerize in the hydrodesulphurization or adsorption reactors, in particular if the adsorbant is acidic, limiting their service life.

This step can also transform light sulphur-containing compounds selected from the list constituted by mercaptans, sulphides and $CS_2$, with a boiling point which is generally lower than that of thiophene, into heavier sulphur-containing compounds the boiling point of which is higher than that of thiophene. These heavier sulphur-containing compounds are generally derived from mercaptans reacting with olefins. In the present process, a majority of said heavy compounds formed are evacuated in the heavy fraction after fractionation (step A).

This step is generally carried out in the presence of a catalyst comprising at least one group VIII metal, preferably selected from the group formed by platinum, palladium and nickel, and a support. As an example, a catalyst containing 1% to 20% by weight of nickel deposited on an inert support such as alumina, silica, silica-alumina, a nickel aluminate or a support containing at least 50% alumina, is used. This catalyst operates at a pressure of 0.4 to 5 MPa, at a temperature of 5° C. to 250° C., with an hourly space velocity of liquid of 1 $h^{-1}$ to 10 $h^{-1}$. A further metal from group VIB, for example molybdenum or tungsten, can be associated to form a bimetallic catalyst. This group VIB metal, if associated with the group VIII metal, is deposited on the support in an amount of 1% by weight to 20% by weight.

The choice of operating conditions is particularly important. Most generally, pressure is used in the presence of a quantity of hydrogen that is in slight excess with respect to the stoichiometric value necessary to hydrogenate the diolefins. The hydrogen and the feed to be treated are injected as downflows or upflows into a reactor, preferably with a fixed bed of catalyst. The temperature is more generally in the range 50° C. to 300° C., preferably in the range 80° C. to 250° C., more preferably in the range 120° C. to 210° C.

The pressure is selected so that it is sufficient to maintain more than 80% and preferably more than 95% by weight of the gasoline to be treated in the liquid phase in the reactor; more generally, it is 0.4 to 5 MPa and preferably more than 1 MPa. An advantageous pressure is in the range 1 to 4 MPa, limits included.

The hourly space velocity under these conditions is of the order of 1 to 12 $h^{-1}$, preferably of the order of 2 to 10 $h^{-1}$.

The light fraction of the catalytic cracking gasoline cut can contain up to a few % by weight of diolefins. After hydrogenation, the diolefin content is reduced to less than 3000 ppm, or even less than 2500 ppm, preferably less than 1500 ppm. In certain cases, less than 500 ppm can be obtained. The dienes content after selective hydrogenation may even be reduced to less than 250 ppm.

Concomitantly with the selective hydrogenation of diolefins, the double bond of external olefins is isomerized to internal olefins. This isomerization results in a slight increase in the octane number (or compensation of the octane number due to a slight reduction in olefins). This is due to the fact that internal olefins generally have a higher octane number than that of terminal olefins.

In accordance with one implementation of the invention, step A is carried out in a catalytic hydrogenation reactor which comprises a catalytic reaction zone traversed by the whole of the feed and the quantity of hydrogen necessary to carry out the desired reactions.

Separation and recycling of hydrogen (step E):

The gas recovered during step C contains desorption gas, hydrocarbons and desorbed sulphur-containing compounds, principally in the thiophene form. It can advantageously be treated in the hydrodesulphurization section to transform the desorbed sulphur-containing compounds into $H_2S$. It is preferably injected as a mixture with the heavy gasoline to the inlet to hydrodesulphurization step B. The sulphur-containing compounds are then transformed into $H_2S$.

After hydrodesulphurization step B, any appropriate means is used to separate the desulphurized gasoline from the hydrogen-rich gas in the effluent obtained (step E1). This separation is carried out using processes that are known in the art. As an example, the effluent from section B can be cooled to condense the hydrocarbons and separate the gasoline from the hydrogen-rich and $H_2S$-rich gas.

The hydrogen sulphide is separated from the desorption gas containing hydrogen in an amine washing step E2 using a process that is well known to the skilled person. At least a portion of the desorption gas comprising hydrogen can then be recycled to the desorption step C.

The invention claimed is:

1. A process for reducing the quantity of sulphur present in a gasoline feed, comprising the following steps:

a) bringing said gasoline feed containing sulphur-containing compounds into contact with an adsorbant having a selectivity for sulphur-containing compounds under conditions for producing, at the outlet from the contact zone, a desulphurized effluent which is collected, said adsorption being carried out in the gas phase;

b) gas phase desorption of the sulphur-containing compounds present on said adsorbant using a gaseous fluid comprising hydrogen and deriving from a hydrodesulphurisation zone to obtain a gaseous effluent comprising desorbed sulphur-containing compounds and the gaseous fluid comprising hydrogen;

c) sending the effluent from step b) to said hydrodesulphurization zone and desulphurizing it therein.

2. A process according to claim 1, in which a step for stripping the hydrocarbons present in the pores of the adsorbant is carried out prior to the desorption step.

3. A process according to claim 1, in which the adsorbant comprises at least one component from silicas, aluminas, zeolites, activated charcoal, clays, metal oxides or reduced metals.

4. A process according to claim 1, in which adsorption steps and desorption steps are carried out successively in a permutable reactor, a simulated moving or a moving bed.

* * * * *